US007187354B2

(12) United States Patent
Min et al.

(10) Patent No.: US 7,187,354 B2
(45) Date of Patent: Mar. 6, 2007

(54) ORGANIC ELECTROLUMINESCENT DISPLAY AND DRIVING METHOD THEREOF

(75) Inventors: Woong-Kyu Min, Seoul (KR); Cheol-Woo Park, Suwon (KR); Ho-Yong Jeong, Kyungsangbuk-do (KR)

(73) Assignee: Samsung Electronics Co., Ltd. (KR)

( * ) Notice: Subject to any disclaimer, the term of this patent is extended or adjusted under 35 U.S.C. 154(b) by 243 days.

(21) Appl. No.: 10/503,026

(22) PCT Filed: Sep. 19, 2002

(86) PCT No.: PCT/KR02/01789

§ 371 (c)(1),
(2), (4) Date: Jul. 29, 2004

(87) PCT Pub. No.: WO03/065336

PCT Pub. Date: Aug. 7, 2003

(65) Prior Publication Data

US 2005/0078064 A1 Apr. 14, 2005

(30) Foreign Application Priority Data

Jan. 30, 2002 (KR) ..... 10-2002-0005334

(51) Int. Cl.
*G09G 3/10* (2006.01)

(52) U.S. Cl. ..... 345/89; 345/45; 345/76; 345/690; 313/504; 315/169.3

(58) Field of Classification Search ..... 345/36, 345/45, 63, 76, 77, 87, 89; 313/483, 504; 315/169.3

See application file for complete search history.

(56) References Cited

U.S. PATENT DOCUMENTS 5,724,054 A * 3/1998 Shinoda ..... 345/60

(Continued)

FOREIGN PATENT DOCUMENTS

KR 1995-0015188 6/1995

(Continued)

OTHER PUBLICATIONS

PCT International Search Report; International Application No. PCT/KR02/01789; International filing date: Sep. 19, 2002; Date of Mailing: Dec. 16, 2002.

*Primary Examiner*—Bipin Shalwala
*Assistant Examiner*—Vincent E. Kovalick
(74) *Attorney, Agent, or Firm*—Cantor Colburn LLP

(57) ABSTRACT

The present invention relates to an organic electroluminescent display and a driving method thereof, which divides one frame into a plurality of subframes. Since the present invention divides one frame into several subframes, and drives an organic EL device with the subframes assigned to the upper bits and with the corrected gray data for representing the detailed grays between the basic grays during the subframes assigned to the lower bits, it is possible to represent sufficient number of grays regardless of the unstable luminescence characteristics of an organic EL device.

10 Claims, 5 Drawing Sheets

U.S. PATENT DOCUMENTS

| | | | | |
|---|---|---|---|---|
| 5,818,419 | A * | 10/1998 | Tajima et al. | 345/691 |
| 6,208,083 | B1 * | 3/2001 | Suzuki et al. | 315/169.3 |
| 6,288,496 | B1 * | 9/2001 | Suzuki et al. | 315/169.3 |
| 2001/0028334 | A1 * | 10/2001 | Ishizuka | 345/76 |
| 2001/0038372 | A1 * | 11/2001 | Lee | 345/89 |
| 2001/0052597 | A1 * | 12/2001 | Young et al. | 257/59 |
| 2002/0118150 | A1 * | 8/2002 | Kwon | 345/76 |
| 2003/0058199 | A1 * | 3/2003 | Kasai | 345/76 |

FOREIGN PATENT DOCUMENTS

| | | |
|---|---|---|
| KR | 2001-0050612 | 6/2001 |
| KR | 2001-0051253 | 6/2001 |
| KR | 2001-0098788 | 11/2001 |

* cited by examiner

ORGANIC ELECTROLUMINESCENT DISPLAY AND DRIVING METHOD THEREOF

BACKGROUND OF THE INVENTION (a) Field of the Invention

The present invention relates to an organic electroluminescent (referred to as "EL" hereinafter) display and a driving method thereof, and, in particular, to an organic EL display and a driving method thereof with a single frame divided into several frames.

(b) Description of the Related Art

An organic EL display is a display emitting light by electrically exciting a fluorescent organic material, and it displays images by driving M×N organic luminescent cells. An organic luminous cell includes, as shown in FIG. 1, an anode (ITO), an organic thin film, and a cathode layer Metal. The organic thin film is formed of multiple-layers including an emitting layer (EML), an electron transport layer (ETL), and a hole transport layer (HTL) for improving light-emitting efficiency by balancing electrons and holes, and also includes separate an electron injecting layer (EIL) and a hole injecting layer) (HIL).

The organic luminescent cells are risen by a simple matrix (or passive matrix) type and an active matrix type using thin film transistors (TFTs). The simple matrix driving is to select cathode lines and anode lines crossing each other, while the active matrix driving to connect TFTs and capacitors to ITO pixel electrodes and to store voltages into the capacitors.

FIG. 2 is a circuit diagram of a conventional pixel circuit of a representative one of N×M pixels, for driving an organic EL device using TFTs. Referring to FIG. 2, the organic EL device OELD is connected to a current driving transistor Mb for supplying light-emitting current. The amount of current driven by the current driving transistor Mb is controlled by data voltage supplied through a switching transistor Ma. A capacitor C for keeping the supplied voltage for a predetermined time is connected between a source and a gate of the transistor Mb. A gate of the transistor Ma is connected to the n-th scan line Scan[n], and the source thereof is connected to a data line Data[m].

Seeing an operation of a pixel with the structure, a scan signal applied to the gate of the transistor Ma turns on the transistor Ma, and then the data voltage $V_{DATA}$ is applied to the gate A of the current driving transistor Mb through the data line. Then, the current flows into the organic EL device OELD through the transistor Mb in response to the data voltage $V_{DATA}$ applied to the gate of the transistor Mb, and the organic EL device OLED emits light.

The amount of the current flowing in the organic EL device is given by Equation 1.

$$I_{OLED} = \frac{\beta}{2}(V_{GS} - V_{TH})^2 = \frac{\beta}{2}(V_{DD} - V_{DATA} - V_{TH})^2 \quad (1)$$

where $I_{OLED}$ is a current flowing in the organic EL device, $V_{GS}$ is a gate-source voltage of the transistor Mb, $V_{TH}$ is a threshold voltage of the transistor Mb, $V_{DD}$ is a supply voltage, $V_{DATA}$ is a data voltage, and β is a constant.

According to Equation 1, the current supplied to the organic EL device depends on the applied data voltage $V_{DATA}$ in the pixel circuit shown in FIG. 2, and the organic EL device turns to be luminescent in response to the supplied current. Here, the applied data voltage $V_{DATA}$ has multiple values in a predetermined range.

However, the conventional frame-based driving method of an organic EL display has a problem of insufficient grayscale representation due to the unstable luminescence characteristics of the conventional organic EL devices of the organic EL display.

SUMMARY OF THE INVENTION

To solve the problems the present invention is to provide an organic EL display and a driving method thereof capable of representing sufficient number of grays by dividing one frame into a plurality of subframes regardless of the unstable luminescence characteristics of the organic EL device.

The organic EL display according to one aspect of the present invention includes: a panel including a plurality of data lines, a plurality of scan lines intersecting the data lines, and a plurality of pixels provided on areas defined by the data lines and the scan lines, each pixel including an organic EL device; a scan driver applying scan signals to the scan lines; a data driver applying data voltages corresponding to gray data to the data lines; and a subframe generator receiving a data signal and a synchronization signal for one frame, dividing the frame into a plurality of subframes, and outputting a corrected gray data and a corrected synchronization signal for each subframe.

Here, it is preferable that the subframe generator outputs a first corrected data for subframes assigned to upper bits of an input data signal to represent a basic gray, and outputs a second corrected data for a subframe corresponding to lower bits of the input data signal to represent a detail gray between basic grays.

A method of driving an organic EL display according to one aspect of the present invention is a driving method for an organic EL display including a plurality of data lines, a plurality of scan lines intersecting the data lines, and a plurality of pixels formed on areas defined by the data lines and the scan lines, each pixel including an organic EL device. The method includes: a first step receiving a data signal and a synchronization signal for a frame; a second step dividing the frame into a plurality of subframes and outputting a corrected gray data and a corrected synchronization signal for each subframe; a third step apply scan signals to the scan lines by subframe unit; and a fourth step applying data voltages corresponding to the corrected gray data outputted in the second step to the data lines by subframe unit.

DETAILED DESCRIPTION OF THE PREFERRED EMBODIMENTS

Preferred embodiments of the present invention will be described in detail with reference to accompanying drawings.

The present invention suggests a method of driving an organic EL display by introducing a concept of subframe in order to solve the problem of a conventional driving method to implement grays frame by frame.

Embodiments of the present invention drive an organic EL display by unit of subframe obtained by dividing a single frame. Driving methods according to the present invention will be described based on exemplary 32 grayscale representation.

A first embodiment of the present invention implements 32 grays using five subframes and 15 bits i.e., five bits for each of red (R), green (G) and blue (B), which is described now.

First, a 5-bit input data (for each of R, G and B) is divided into upper two bits (MSB) and lower three bits (LSB), and then, the four of the five subframes are made to represent the value of the upper two bits and the other one is made to represent the value of the lower three bits.

According to the first embodiment the present invention, the organic EL device emits light every subframe with an amount depending on data signals, while human eyes detect light with an amount equal to the sum of the light emission for five subframes.

Describing a function and concept employed in the first embodiment of the present invention, four among the five subframes representing the MSB of the input data determine reference (basic) grays spaced apart from each other by a large distance and the other one determines detailed (subdivided) grays between the basic grays.

Figure 1:
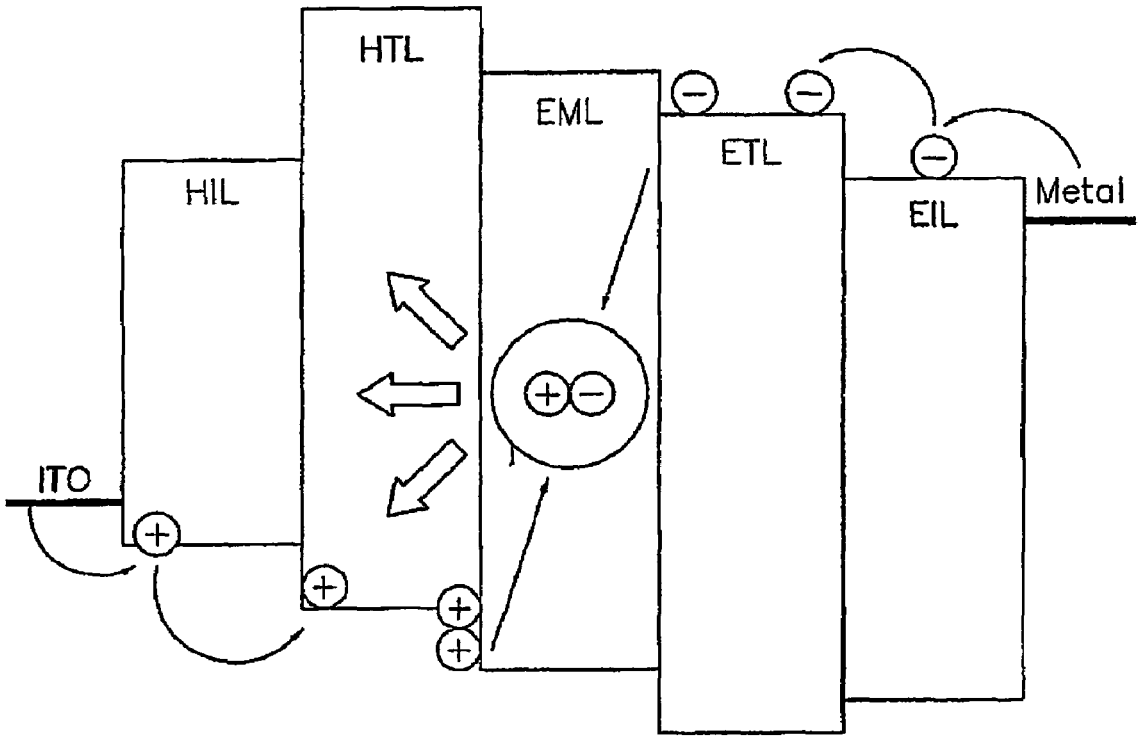
FIG. 1 illustrates a typical organic EL device.
Figure 2:
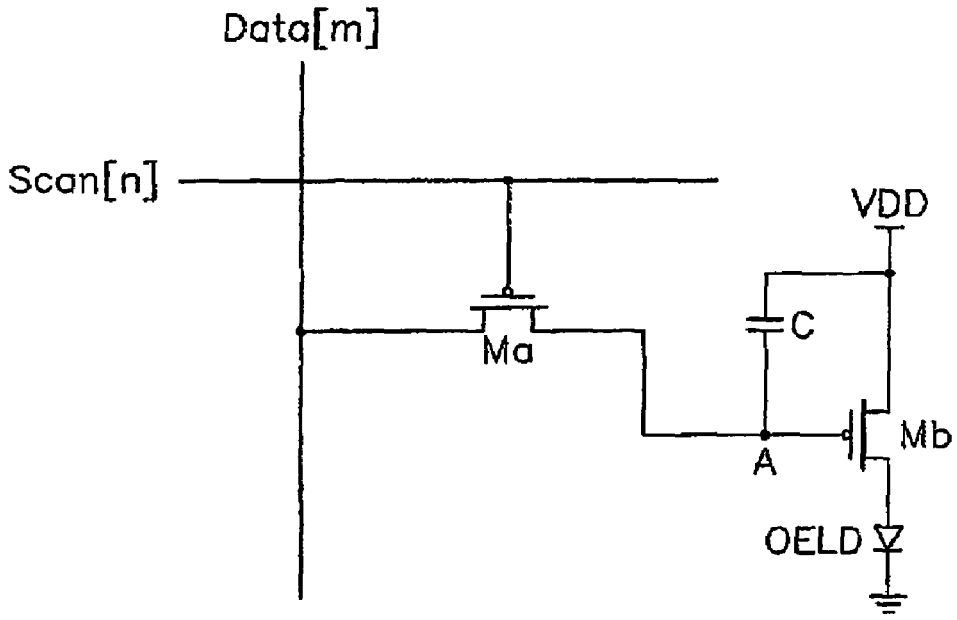
FIG. 2 is a circuit diagram of a conventional pixel circuit for driving an organic EL device.
Figure 3:
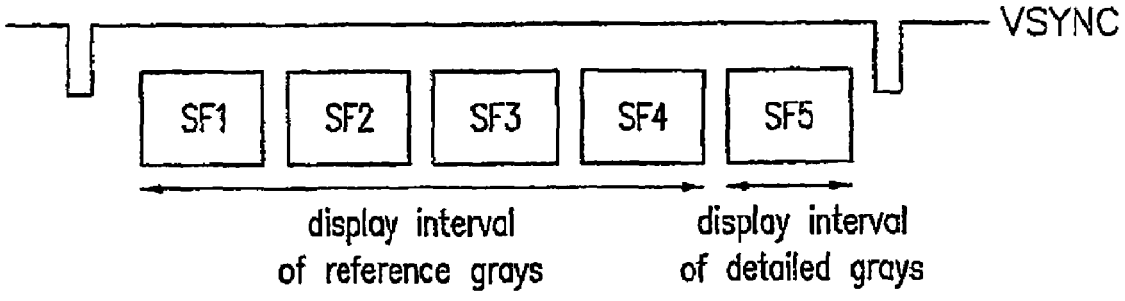
FIG. 3 illustrates an implementation of subframes according to a first embodiment of the present invention.

In detail, according to the first embodiment of the present invention, the basic grays are determined by the four subframes SF1, SF2, SF3 and SF4, and the detailed grays between the basic grays are determined by the other one subframe SF5 as shown in FIG. 3. Although FIG. 3 shows that the subframe for representing the detailed grays comes last, it is not limited thereto.

Next, the process of determination of the four subframes by the upper two bits will be described by FIG. 4.

Figure 4:
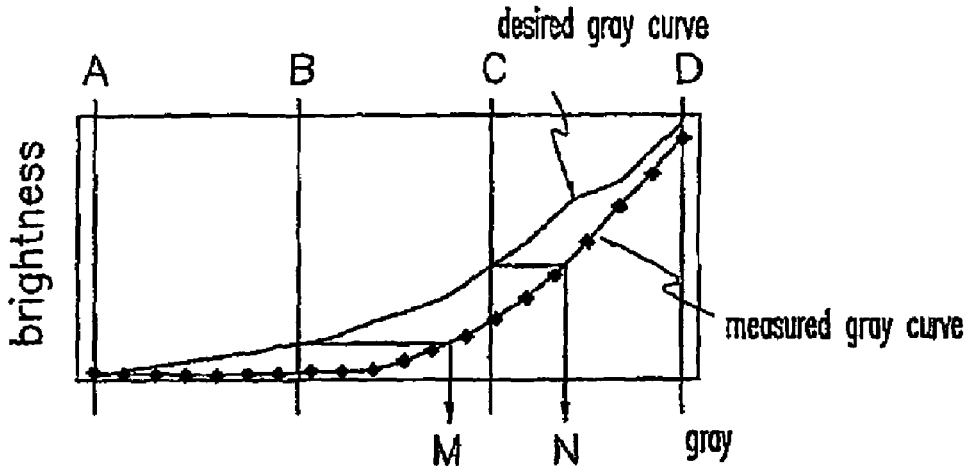
FIG. 4 illustrates an exemplary output of corrected gray data according to the first embodiment of the present invention.

FIG. 4 shows a measured gray curve Gm for the organic EL display and a desired gray curve Gd. Here, the horizontal axis and the vertical axis indicate gray data and brightness, respectively.

Since the values that the upper two bits can have are "00," "01," "10" and "11," the horizontal axis is divided into four equal parts. The straight lines A, B, C and D are the dividing lines). The lines A, B, C and D are assigned to "00," "01," "10" and "11" of the upper two bits, respectively.

Then, after finding an intersection between the line corresponding to the upper two bits of an input data and the desired gray curve Gd, a horizontal line parallel to the horizontal axis and passing through the intersection is drawn. A gray data corresponding to a meeting point between the horizontal line and the measured gray curve Gm is outputted as a corrected gray data. For example, when the value of the upper two bits is "01," an intersection point between the line B and the gray curve Gd is obtained, and thereafter, a gray data corresponding to a meeting point M between a line, which is parallel to the horizontal axis and passes through the intersection point, and the measured gray curve Gm is outputted as a corrected gray data.

In the meantime, the corrected data value corresponding to the lower three bits is outputted for adjusting a detailed gray during the other subframe SF5. The corrected gray data for eight values of the lower three bits may be obtained in substantially the same manner as shown in FIG. 4, yet it is different in that eight straight lines are necessary to divide the horizontal axis into eight equal parts. Both a corrected gray data and a non-corrected gray data axe alternatively employed as a gray data outputted during the other subframe SF5 for adjusting detailed gray.

Although the first embodiment of the present invention exemplifies eight detailed grays, the present invention is not limited thereto, and the number of the detailed grays is determined considering the luminescence characteristics of the organic EL device.

According to the above-described first embodiment of the present invention, the organic EL device is driven to display the basic grays based on the corrected gray data corresponding to the values "00," "01," "10," and "11" of the upper two bits during the four shames SF1, SF2, SF3 and SF4, and to display the detailed grays between the basic grays based on the gray data corresponding to the lower three bits during the other one subframe SF5.

That is, according to the first embodiment of the present invention, four basic grays are determined during four subframes and eight detailed grays are determined during the other one subframe, and 32 grays (=4×8) are consequently implemented.

According to the first embodiment of the present invention, since all values of upper m bits have corresponding subframes, the number of the subframes for displaying the basic grays for the upper m bits is $2^m$.

Next, a method of implementing the concept of subframe according to a second embodiment of the present invention will be described with reference to FIG. 5.

Figure 5:
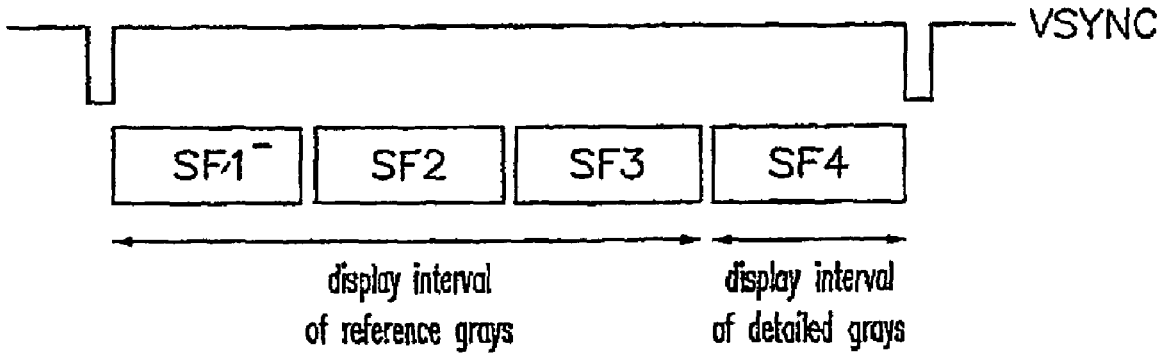
FIG. 5 illustrates an implementation of subframes according to a second embodiment of the present invention.

According to the second embodiment of the present invention shown in FIG. 5, a method of implementing 32 grays using four subframes is proposed.

According to the second embodiment of the present invention shown in FIG. 5, three among the four subframes representing the MSB of the input data determine the sparsely-spaced basic grays and the other one determines the detailed grays between the basic grays. Here, a state of each of the three subframes determining the basic grays is determined only by on or off operation. Accordingly, the number of cases represented by the three subframes is following four cases:

1. all the three are off;
2. only one is on;
3. two are on; and
4. all the three are on.

In detail, according to the second embodiment of the present invention, the subframes for determining a basic gray for an upper two bit data are determined as described now.

All the three subframes all are off for the MSB of "00," only one subframe is on and the other two subframes are off for the MSB of "01," two subframes are on and the other one subframe is off for the MSB of "10," and all the three subframes are on for the MSB of "11."

According to the above-described second embodiment of the present invention the subframes determining the basic grays based on the MSB performs on/off operation, it has an advantage of reducing the number of the subframes relative to the first embodiment.

Figure 6:
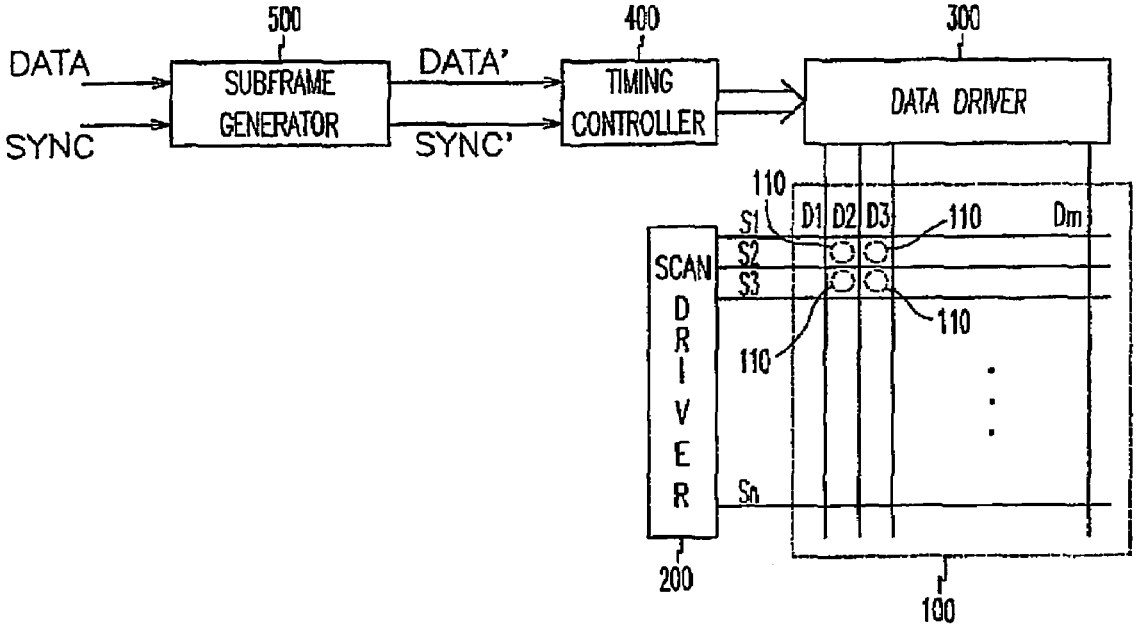
FIG. 6 illustrates an organic EL display according to and embodiment of the present invention.

FIG. 6 illustrates an organic EL display according to an embodiment of the present invention.

Referring to FIG. 6, an organic EL display according to an embodiment of the present invention includes an organic EL display panel 100, a scan driver 200, a data driver 300, a timing controller 400, and a subframe generator 500.

The organic EL display panel 100 includes a plurality of data lines D1–Dm transmitting data voltages corresponding to image signals, a plurality of scan lines transmitting scan signals S1–Sm, and a plurality of pixel circuits 110 provided at a plurality of pixels defined by the data lines and the scan lines.

The data driver 300 applies the data voltages corresponding to the image signals to the data lines, and the scan driver 200 sequentially applies the scan signals to the scan lines.

The subframe generator 500 receives data signals DATA and a synchronization signal SYNC, divides one frame into a plurality of subframes, and outputs corrected data signals DATA' and a corrected synchronization signal SYNC' for the subframes. As described above, the subframe generator 500 outputs the corrected data DATA' for the subframes to display the basic grays corresponding to the MSB of the input data signal DATA, and outputs the corrected data for the subframes to display the detailed grays between the basic grays, which correspond to the LSB of the inputted data signal DATA.

The timing controller 400 receives the corrected data DATA' and the synchronization signal SYNC' for the respective subframes outputted from the subframe generator 500, generates control signals for controlling the data driver 300 and the scan driver 200, and outputs the corrected data DATA' to data driver 300.

Figure 7:
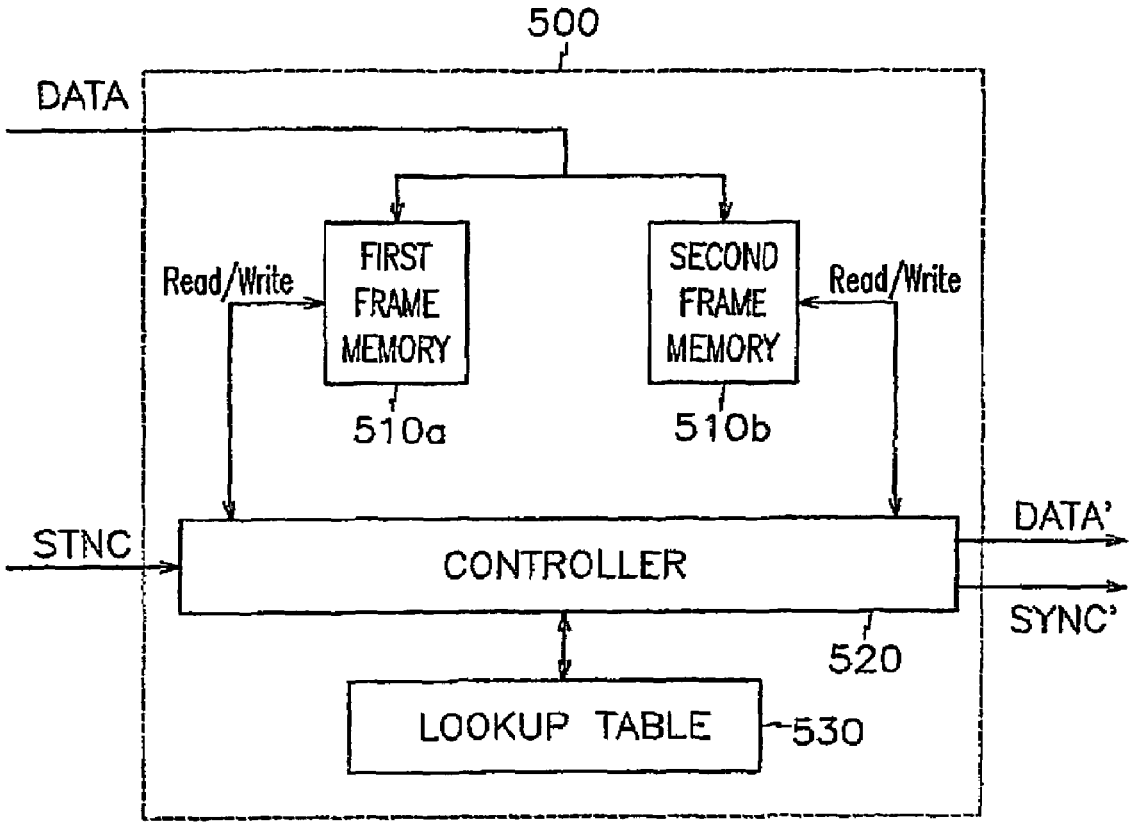
FIG. 7 illustrates a subframe generator according to an embodiment of the present invention.

FIG. 7 illustrates an exemplary detailed configuration of the subframe generator 500 shown in FIG. 6.

As shown in FIG. 7, the subframe generator 500 according to an embodiment of the present invention includes first and second frame memories 510*a* and 510*b*, a controller 520, and a lookup table 530.

The first and the second frame memories 510*a* and 510*b* alternately store odd frame data and even frame data among the input data DATA received from an external device under the control of the controller 520.

The lookup table 530, as described with reference to FIG. 4, stores corrected gray data corresponding to the MSB and corrected gray data corresponding to the LSB.

The controller 520 leads out the data stored in the first frame memory 510*a* or the second frame memory 510*a* and 510*b* responsive to the synchronization signal SYNC. According to the embodiment of the present invention, for example, the controller 520 reads out the odd frame data stored in the first frame memory 510*a* and simultaneously stores the data DATA from the external device to the second frame memory 510*b*, thereby increasing the efficiency of the flame memories.

The controller 520 analyzes the LSB and the LSB of the data read from the frame memories 510*a* and 510*b*, assigns the MSB and the LSB to appropriate subframes, and brings the corrected gray data for the respective subframes from the lookup table 530. Thereafter, the controller 520 outputs the corrected gray data DATA' brought from the lookup table 530 and the synchronization signal SYNC' for the respective subframes.

The corrected gray data DATA' and the synchronization signal SYNC' for the respective subframes outputted from the controller 530 are transmitted to the data driver 300 and the scan driver 200 via the ting controller 400 to drive the organic EL device panel 100 subframe by subframe.

The above-described organic EL display according to the embodiment of the present invention divides the input data into the upper bits and the lower bits and assigns the upper bits and the lower bits to the subframes. The organic EL display is driven based on the corrected gray data for the basic grays during the subframes assigned to the upper bits to output the light amount of the basic grays, and is driven based on the corrected gray data for the detailed grays between the basic grays during the subframe assigned to the lower bits to output the light amount of the detailed grays.

The embodiments of the present invention have been described and the present invention is not limited to the embodiments, and rather it is possible to make a variety of modification and change.

For example, although the embodiments of the present invention have exemplified 32 grayscales, the present invention is also applicable to implement another number of grays. Furthermore, although the subframes have the same duration in the embodiments of the present invention, the subdues may have different durations.

As described above, since the present invention divides one frame into several subframes, and drives an organic EL device with the corrected gray data for representing the basic grays during the subframes assigned to the upper bits and with the corrected gray data for representing the detailed grays between the basic grays during the subframes assigned to the lower bits, it is possible to represent sufficient number of grays regardless of the unstable luminescence characteristics of an organic EL device.

What is claimed is:

1. An organic electroluminescent (EL) display comprising:

a panel including a plurality of data lines, a plurality of scan lines intersecting the data lines, and a plurality of pixels provided on areas defined by the data lines and the scan lines, each pixel including an organic EL device;

a scan driver applying scan signals to the scan lines;

a data driver applying data voltages corresponding to gray data to the data lines; and a subframe generator receiving a data signal and a synchronization signal for one frame, dividing the frame into a plurality of subframes, and outputting a corrected gray data and a corrected synchronization signal for each subframe.

2. The organic EL display of claim 1, further comprising a timing controller receiving the corrected gray data and the corrected synchronization signal for each subframe from the subframe generator and generating a control signal for driving the scan driver and the data driver.

3. The organic EL display of claim 1 or claim 2, wherein the subframe generator outputs a first corrected data for subframes assigned to upper bits of an input data signal to represent a basic gray, and outputs a second corrected data for a subframe corresponding to lower bits of the input data signal to represent a detail gray between basic grays.

4. The organic EL display of claim 3, wherein the number of the subframes corresponding to the upper bits is $2^m$ when a bit number of the upper bits is m.

5. The organic EL display of claim 3, wherein on and off of the subframes for representing the basic gray are determined by the upper bits.

6. The organic EL display of claim 3, wherein the subframe generator comprises:

a frame memory unit storing input data signal by frame;

a lookup table storing the first corrected data and the second corrected data;

a controller reading the data signal stored in the frame memory unit in response to the synchronization signal, analyzing the data read from the frame memory unit into upper-bit data and lower-bit data, assigning the upper-bit data and the lower-bit data to subframes, and bringing gray data for the respective subframes from the lookup table.

7. The organic EL display of claim 6, wherein the frame memory unit comprises a fist frame memory for storing data signal of odd frame and a second frame memory for storing data signal of even frame.

8. The organic EL display of claim 7, wherein the controller reads the data signal of odd frame stored in the first frame memory and simultaneously stores the data signal of even frame from an external device to the second frame memory.

9. A method of driving an organic electroluminescent (EL) display including a plurality of data lines, a plurality of scan lines intersecting the data lines, and a plurality of pixels formed on areas defined by the data lines and the scan lines and including respective organic EL devices, the method comprising:

a fist step receiving a data signal and a synchronization signal for a frame;

a second step driving the frame into a plurality of subframes and outputting a corrected gray data and a corrected synchronization signal for each subframe;

a third step applying scan signals to the scan lines by subframe unit; and a fourth step applying data voltages corresponding to the corrected gray data outputted in the second step to the data lines by subframe unit.

10. The method of claim 9, wherein the second step comprises:

outputting a first corrected data used in subframes corresponding to upper-bit data of an input data signal and representing a basic gray; and outputting a second corrected data used in subframes corresponding to lower-bit data of the input data signal and representing a detailed gray between basic grays.

* * * * *